United States Patent [19]

Borg

[11] Patent Number: 4,576,581

[45] Date of Patent: Mar. 18, 1986

[54] REVERSIBLE MAGNUS PROPELLER

[76] Inventor: John L. Borg, 8200 Toro Creek Rd., Atascadero, Calif. 93422

[21] Appl. No.: 595,306

[22] Filed: Mar. 30, 1984

Related U.S. Application Data

[63] Continuation-in-part of Ser. No. 325,741, Nov. 30, 1981, abandoned.

[51] Int. Cl.[4] ..... B63H 23/16

[52] U.S. Cl. ..... 440/86; 244/206; 416/4

[58] Field of Search ..... 244/206, 10, 21, 51; 416/146 R, 146 B, 4; 440/86, 51, 91–93; 415/90; 74/665 F, 665 H, 665 P, 378, 379, 321, 385, 347, 353, 355; 114/144 R, 144 RE

[56] References Cited

U.S. PATENT DOCUMENTS

| | | | |
|---|---|---|---|
| 439,036 | 10/1890 | Omstead | 74/321 |
| 1,041,825 | 10/1912 | Low | 416/4 |
| 1,834,558 | 12/1931 | Wander | 416/4 |
| 2,307,418 | 1/1943 | McDonald | 416/4 |
| 2,916,095 | 12/1959 | Mades | 416/146 B |
| 4,225,286 | 9/1980 | Fork | 416/4 |

FOREIGN PATENT DOCUMENTS

| | | | |
|---|---|---|---|
| 659443 | 6/1929 | Fed. Rep. of Germany | 416/4 |
| 2006885 | 5/1929 | United Kingdom | 416/4 |

*Primary Examiner*—Trygve M. Blix
*Assistant Examiner*—Thomas J. Brahan
*Attorney, Agent, or Firm*—Harry W. Brelsford

[57] ABSTRACT

The thrust of a Magnus propeller is made reversible by reversing the rotation of the Magnus cylinders independently of the direction of rotation of the propeller shaft. Reversible drives for the cylinders are provided that are mechanical, fluid or electric. Reversible motors for the propeller shaft are provided as an alternative reversing mechanism while the cylinders continue to rotate in the same direction. Separate motor drives are provided for the Magnus cylinders and the propeller shaft.

11 Claims, 17 Drawing Figures

REVERSIBLE MAGNUS PROPELLER

This is a continuation-in-part of my copending application Ser. No. 325,741 filed Nov. 30, 1981, now abandoned.

TECHNICAL FIELD

This invention relates to propellers for boats and ships and has particular reference to reversible Magnus effect propellers.

BACKGROUND OF THE PRIOR ART

The Magnus effect was first publicized by Professor G. Magnus in 1853. The phenomenon is well-known in various arts including the curved pitches of baseball and the shooting of airplane guns transversely to the airplane's path of travel. The use of the Magnus effect as a rudder for a boat was disclosed in 1929 in U.S. Pat. No. 1,697,779. Other patents disclose the use of the Magnus effect for airplane lift and other use for assisting in submarine steering. Briefly stated, when a rotating cylinder encounters a fluid flow at an angle to its rotational axis, a lifting force is created perpendicularly to the flow direction. If a rotating cylinder is mounted on a vertical axis, a force is developed at right angles to the direction of water flowing past the cylinder, left or right depending upon the direction of rotation. The Magnus effect is therefore ideal for rudders for boats.

The control of Magnus effect rudders for boats and other watercraft has not heretofore been developed on an efficient basis, that is, obtaining the maximum amount of steering for a given expenditure of energy to rotate the Magnus cylinder.

BRIEF SUMMARY OF THE INVENTION

I have discovered that the peripheral speed of a Magnus rudder should be closely regulated to the velocity of the water passing the Magnus cylinder. If the Magnus rudder depends upon the forward or backward motion of the boat or ship for flow past the Magnus rudder, there will be no steering when the boat has no motion with respect to the water. I avoid this no performance condition by placing the Magnus rudder in the slip stream, forward or reverse, of the propeller of the boat or ship. In this fashion, steering is obtained even when the boat is stationary with respect to the water. I have determined that the maximum steering takes place when the peripheral speed of the Magnus drum is four times the velocity of water flow past the Magnus rudder. Any added peripheral speed is generally wasted as large increases in peripheral speed give only small increases in steering effort. The increase in peripheral speed over the optimum ratio requires large expenditures of power and this power is generally wasted.

I have further found that within reasonable limits the speed of water flowing around a Magnus effect rudder placed in the propeller slip stream is closely related to the r.p.m. of the propeller and this in turn is directly related to r.p.m. of the motor driving the propeller.

I therefore regulate the maximum peripheral speed of my Magnus rudder by relating it to the r.p.m. of the motor or engine driving the propeller. This can be done by a generator-motor relationship, mechanical drive including a variable transmission, or hydraulically by hydraulic pump driving a hydraulic motor. In each case, however, means must be provided to give a range of Magnus rotation from zero to maximum so that the boat operator can select any desired amount of steering at any time.

BRIEF DESCRIPTION OF THE DRAWINGS

Various objects, advantages and features of the invention will be apparent in the following description and claims, considered together with the drawings forming an integral part of this specification and in which

FIGS. 11 A and 11 B are schematic sectional views along the line A—A of FIG. 11.

DETAILED DESCRIPTION OF THE INVENTION

Figure 1:
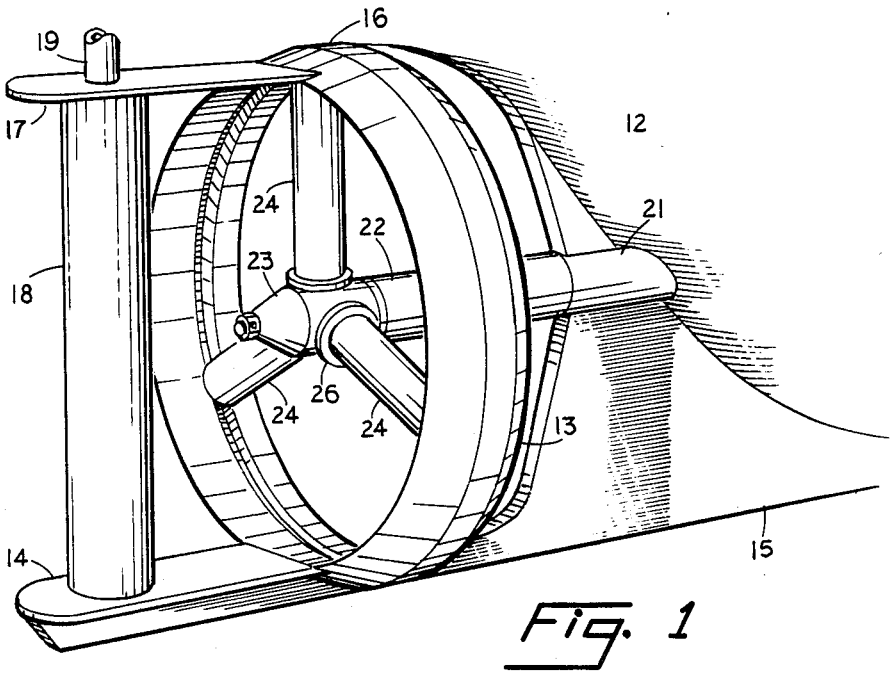
FIG. 1 is a three dimensional view of a Magnus propeller associated with a Magnus rudder at the stern of a vessel.

Referring to FIG. 1 there is illustrated the hull 12 of a boat having a skeg 15 projecting therefrom which supports the bottom edge of an annular nozzle 13 as well as a rotor flange 14. The upper part of the nozzle 13 is secured to the boat hull 12 at 16 and projecting from this nozzle is an upper flange plate 17. Mounted for rotation in the flange plates 14 and 17 is a Magnus rudder rotor 18 driven by a shaft 19 projecting through the upper flange plate 17. Also supported by the skeg 15 is a propeller shaft housing 21 terminating in a propeller shaft bearing 22. Rotatable within the bearing 22 is a propeller shaft not shown in FIG. 1 which rotates a propeller hub 23 from which project three radial cylinders 24 which are rotatable on the hub 23 about radial axes. Each cylinder 24 has adjacent to the hub 23 an annular flange 26 which is necessary in order to obtain maximum Magnus effect as the radial cylinders 24 rotate on their radial axes. The nozzle 13 acts as an outer flange for these rotatable Magnus propeller blades 24.

Figure 2:
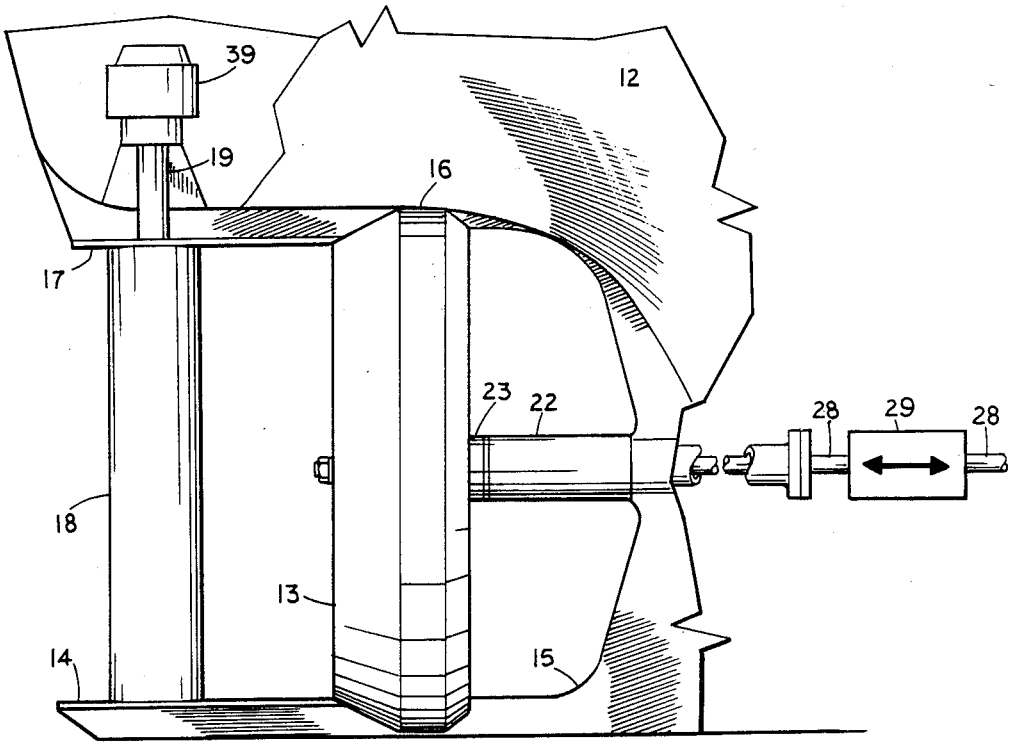
FIG. 2 is an elevation view of the Magnus rudder and the Magnus propeller of FIG. 1.
Figure 3:
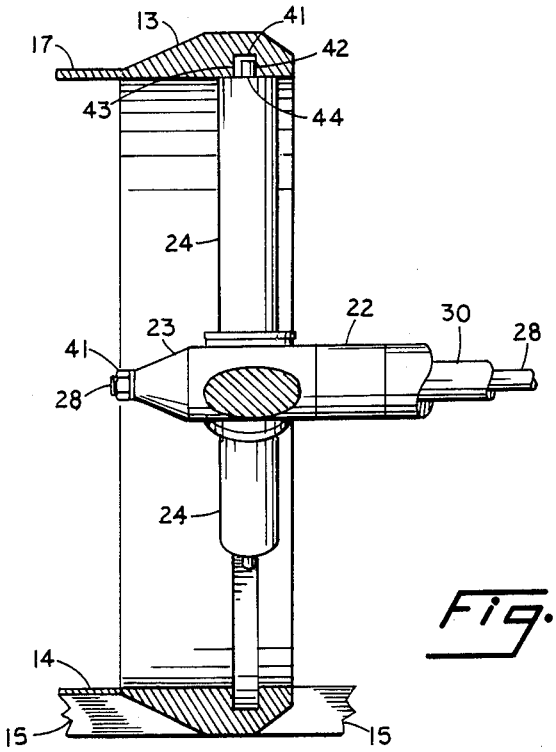
FIG. 3 is an elevation of view with part of the nozzle broken away to show the detailed construction of the Magnus propeller of FIG. 1.
Figure 4:
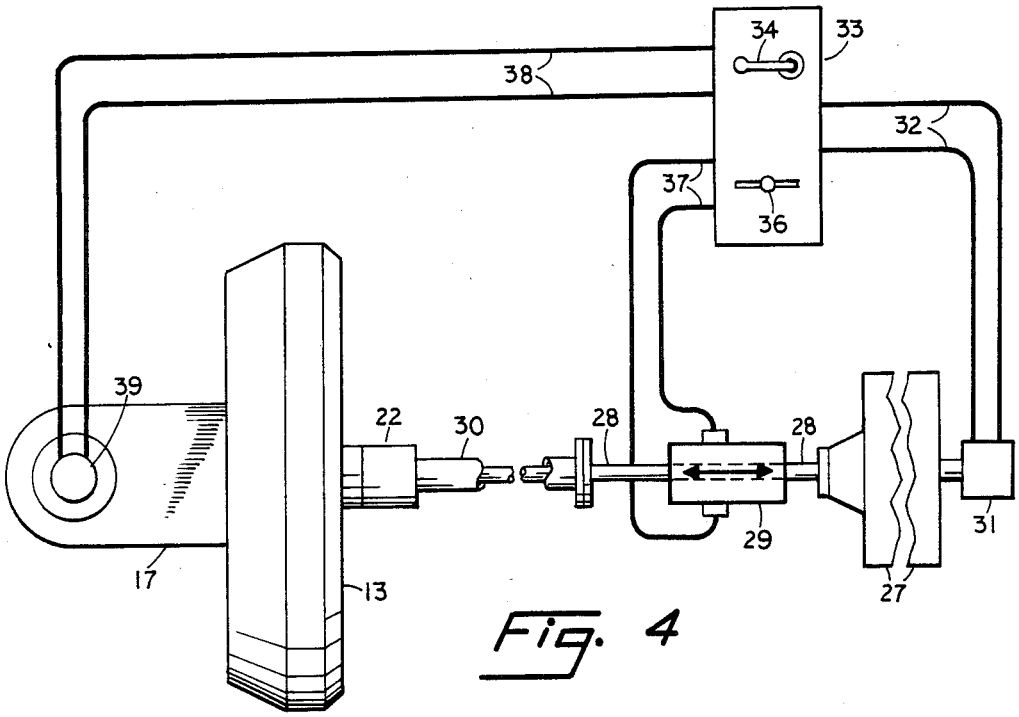
FIG. 4 is a plan view of the drive system for the Magnus propeller and the Magnus rudder employing hydraulic power.

Referring now to FIGS. 2 through 4, there is illustrated the mechanism for driving the Magnus propeller as well as the mechanism for controlling the rotary speed of the Magnus rudder 18. Referring especially to FIG. 4 there is illustrated a motor 27 driving a propeller shaft 28 through a coupling actuator 29. The propeller shaft 28 rotates within a stationary tube 30 connected to the propeller shaft bearing 22. The motor or engine 27 also has connected to it a hydraulic pump 31 having conduits 32 leading to a valve housing 33 which has a speed regulator manual control 34 and a reversing manual control 36. The reversing control 36 controls a flow of liquid through a pair of hydraulic lines 37 leading to the reversing coupling 29. The reversing coupling 29 shifts the propeller shaft 28 along its axis of rotation to effect reversal of the propeller as will be described hereinafter. The unit 29 merely shifts portions of the shaft 28 that are joined together by means of splines or other mechanical connection that allows one part of the shaft 28 to slide with respect to the other. Referring now to the manual control 34 this controls the amount of hydraulic liquid passing through a pair of conduits 38 to a hydraulic motor 39 which is connected to the rudder shaft 19 shown in FIG. 1. Also illustrated in FIG. 4 is the upper flange plate 17 for the upper end of the Magnus rotor 18 described in FIG. 1.

Referring to FIG. 2 the motor 39 is there illustrated together with the hull 12 of the boat, ship or other vessel on which the mechanism is placed.

Referring now especially to FIG. 3 it will be noted that the propeller shaft 28 is securely fastened to the propeller hub 23 by means of a nut 41. Therefore when the shaft 28 is reciprocated along its axis of rotation a small amount the entire hub 23 moves with it. It will be noted in FIG. 3 that the nozzle 13 has an internal annular groove 41 having a forward edge 42 and a rearward edge 43. Projecting from the outer end of each of the propeller cylinders 24 is a solid projection 44 in the form of a pin which may be tapered if desired. This pin 44 of each rotor makes a frictional engagement with either the forward edge 42 or the rearward edge 43 of the groove 41 to thereby rotate the associated cylinder 24. The propeller cylinders 24 accordingly rotate on their radial axes as they revolve about the propeller shaft. The direction of rotation with respect to the direction of revolution decides whether or not a thrust is developed that will propel the ship hull 12 forward or propel the ship hull to the rear. The structure illustrated in FIG. 3 permits the propeller shaft to rotate continuously in the same direction regardless of whether a thrust is created that will propel the ship forward or which will propel the ship to the rear. The only change therefore is in the direction of rotation of each of the propeller cylinders 24. The actuation of the shifting coupler 29 accordingly controls whether the boat moves in a forward direction or in a rearward direction.

OPERATION OF FIGS. 1–4

The Magnus propeller consisting of the hub 23, the propeller cylinders 24 and the nozzle 13 is actuated by rotation of the hub 23 this is done by means of the engine 27 driving a propeller shaft 28 through the splined coupling 29. As will be noted in FIG. 3 the rotation of the propeller cylinders 24 about the propeller shaft 28 causes them also to rotate on their radial axes because of the engagement of the pin 44 with either the forward edge 42 or the rearward edge 43 of the groove 41. Accordingly when the coupler 29 is shifted to the right this causes the engagement of the pin 44 shown in FIG. 3. When the coupler 29 is actuated to move the entire hub 23 to the rear then the pin 44 of each cylinder 24 will engage the rear wall 43 causing rotation of each propeller cylinder 24 in the opposite direction to create a force 180° from that previously obtained. This shifting of the coupler 29 is performed by operation of the manual valve lever 36. The amount of rotation of the Magnus rudder cylinder 18 is controlled by the manual valve lever 34. If only a slight amount of turning action is desired the pilot or other operator of the valve lever 34 moves it only a slight amount to let in a slight amount of liquid to the hydraulic motor 39 which rotates the Magnus rudder cylinder 18. If, however, maximum turning effort is required then in accordance with the invention the entire output of the hydraulic pump 31 is directed to the hydraulic motor 39 and the parameters of pump, motor and diameter of the Magnus cylinder 18 are so selected that the peripheral speed of the Magnus rudder cylinder 18 is not in excess of 4 times the speed of the wash or propeller stream past the Magnus rudder cylinder 18. In this fashion I conserve the energy that might otherwise be wasted with excessive rotational speed of the Magnus rudder 18. This, as mentioned previously is based on my finding that the speed or velocity of the propeller stream past the Magnus rudder is controlled almost directly by the rotational speed of the propeller shaft 18. This in turn is controlled by the rotational speed of the motor 27. Accordingly drive shaft rotational speed is a direct measure of the amount of rotational speed for the Magnus rudder, and this is obtained by means of the direct drive hydraulic pump 31 and the hydraulic motor 39 driven by the output of this pump.

Figure 5:
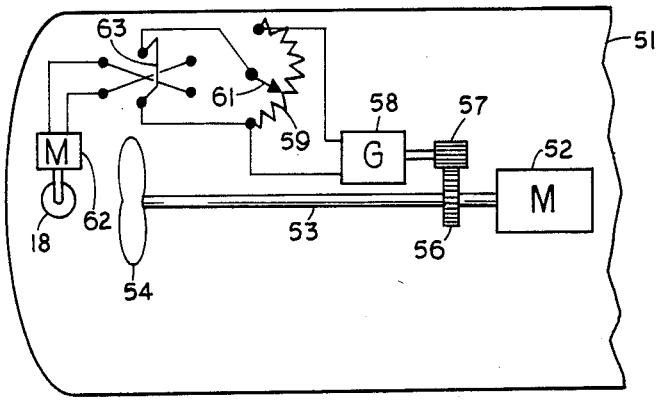
FIG. 5 is a schematic plan diagram of the control of the maximum Magnus rudder peripheral speed by means of a generator-motor circuit.
Figure 6:
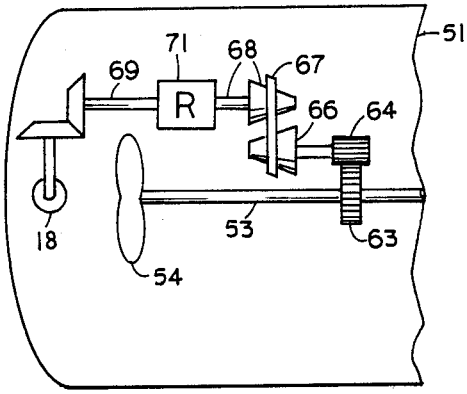
FIG. 6 is a plan view of a schematic control for the maximum peripheral speed of the Magnus rudder employing a mechanical drive between the propeller shaft and the Magnus rudder.
Figure 7:
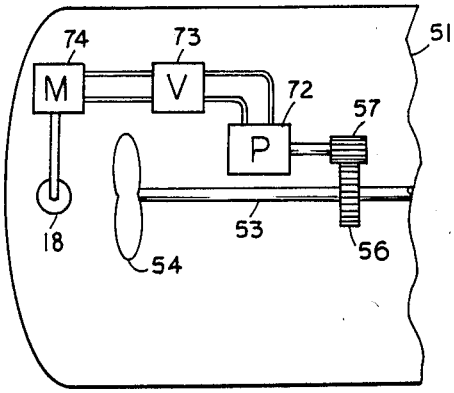
FIG. 7 is a plan view of a schematic circuit for controlling the maximum peripheral speed of a Magnus rudder by use of a hydraulic circuit driven by the propeller shaft.

Referring now to FIGS. 5, 6 and 7, there is illustrated in FIG. 5 an electrical system for achieving the maximum amount of rudder rotation with respect to the propeller shaft rotational speed. In that FIG. 5 a ship 51 has a motor 52 driving a propeller shaft 53 which may have a conventional propeller 54 secured thereto. Mounted on the propeller shaft 53 is a gear 56 which drives a smaller gear 57 which in turn drives an electrical generator 58 the output of which passes across a variable resistance 59. A takeoff arm 61 selects the desired amount of current to drive an electric motor 62 which in turn drives a Magnus rudder cylinder 18. A reversing switch 63 reverses the direction of the rotation of the rudder 18. The maximum output of the generator is utilized when the takeoff arm 61 is at the top of its sweep and this maximum output of the generator drives the motor 62 at such a speed that the peripheral speed of the rudder cylinder 18 is not in excess of 4 times the flow speed generated by the propeller 54 for any selected motor r.p.m.

Referring now to FIG. 6 a propeller shaft 53 drives a propeller 54 but in this case a gear 63 on the propeller shaft drives a smaller gear 64 which in turn drives a cone 66 forming part of a variable transmission including a belt 67 which drives another cone 68. This in turn drives a shaft 69 which rotates the Magnus rudder cylinder 18. A reversing gear shifter 71 allows for reversal of the direction of rotation of the Magnus rudder 18 to give thrust either to the right or to the left as desired. Again, the structure of FIG. 6 is such that the maximum speed of rotation of the Magnus rudder 18 is related to the rotational speed of the propeller shaft 53 and this relationship is 4 times the peripheral speed of the rudder 18 related to the propeller stream velocity from the propeller 54.

Referring to FIG. 7 there is illustrated a modified form of a hydraulic control system wherein the propeller shaft 53 drives a gear 56 which in turn drives a smaller gear 57 to operate a hydraulic pump 72. This in turn supplies fluid under pressure to valve 73 which may incorporate a reversing feature as well as a regulating feature. This valve delivers liquid under pressure to a hydraulic motor 74 which in turn drives the Magnus rudder 18. At maximum rudder action the relationship of the pump and motor and rudder 18 are such that the flow past the rudder will be at 1/4 of the peripheral speed of the rotor 18. Accordingly, therefore, regardless of the velocity of stream flow caused by the propeller 54, the relationship will be maintained in this 4 to 1 ratio, thus realizing considerable savings of energy by avoiding excessive rotational speed for the rudder 18 under the varying conditions.

Figure 8:
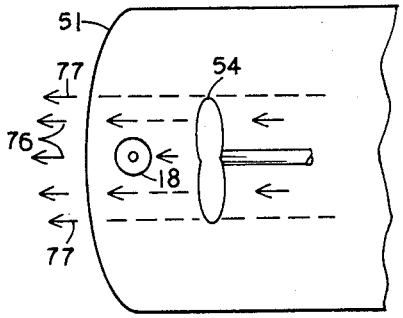
FIG. 8 is a diagram of a boat showing the flow of water past the Magnus rudder when the propeller is rotated in the direction to drive the vessel forward.
Figure 9:
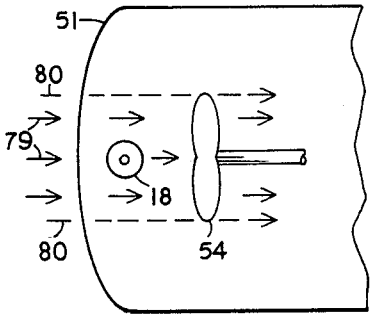
FIG. 9 is a diagram of a boat wherein the propeller is rotated in a direction to cause the boat to move backward and also creating a flow past the Magnus rudder.

Referring to FIGS. 8 and 9 there is illustrated a diagram of the boat having a propeller and showing the propeller stream flow past a Magnus rudder for both propulsion of the ship in a forward direction and propulsion of the ship in a rearward direction. Referring to FIG. 8 a boat 51 has a propeller 54 which creates a propeller stream flow towards the rear as indicated by the arrows 76 and this stream flow has an outer boundary 77. The propeller 54 accordingly creates a flow past a Magnus rudder 18 which is in the form of a rotatable cylinder rotating about a vertical axis. The disclosure in FIG. 9 is similar to FIG. 8 except that the propeller now produces a propeller stream that directs water towards the front of the ship 51. In this case also the stream is indicated by arrows 79 and the outer boundaries of the stream flow are indicated by lines 80. In this fashion the Magnus rudder 18 will function whether the propeller directs water towards the rear or whether it directs water towards the front of the vessel. It will be appreciated however, that the direction of rotation of the Magnus rudder 18 must be changed if the direction of the propeller stream changes, in order to get steering in a given direction.

Figure 10:
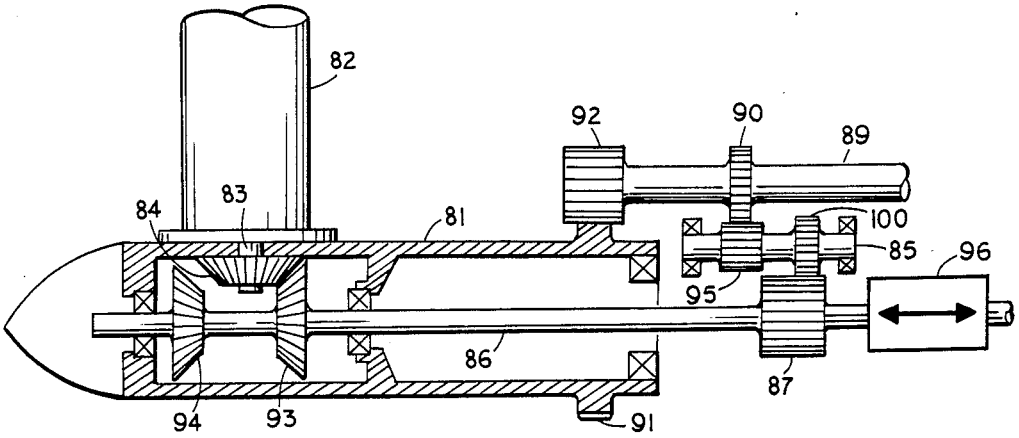
FIG. 10 is a fragmentary sectional view of a modified form of a Magnus propeller wherein the rotation occurs by means of bevel members within the hub of the Magnus propeller.

Referring to FIG. 10 there is illustrated a modified form of drive for rotating the Magnus cylinders of a Magnus propeller such as the array shown in FIG. 1. In this case the Magnus cylinders are driven by mechanisms within the hub itself. A hollow propeller shaft 81 has mounted on its left end one or more Magnus cylinders 82 having a bearing on the hollow propeller shaft 81 at 83. Secured to the bottom end of the bearing shaft 83 is a conical member 84 which for example, may be a bevel gear or a bevel contact surface. Mounted for rotation within the propeller shaft 81 is a cylinder drive shaft 86 which rotates in a direction opposite from the hollow propeller shaft 81. Both shafts 81 and 86 are driven by drive shaft 89 having a spur gear 92 engaging a spur gear 91 secured to the hollow propeller shaft 81. The drive shaft 89 also has a spur gear 90 engaging a gear 95 on a counter shaft 85. The counter shaft 85 also has a gear 100 contacting a spur gear 87 on the cylinder drive shaft 86. In this fashion the cylinder shaft 86 is driven in the opposite direction from the propeller shaft 81.

Secured to the left end of the cylinder drive shaft 86 are a pair of spaced bevel members 93 and 94 which may be bevel gears or bevel contact members. On the right end of the shaft 86 is a longitudinal shifter 96 which can shift the shaft 86 right or left while it is rotating. When the shaft 86 is shifted to the left as illustrated in FIG. 10 the bevel member 93 contacts the bevel member 84 to rotate the cylinder 82 in a given direction. When the drive shaft 86 is shifted to the right then the bevel member 94 engages the bevel member 84 to rotate the Magnus cylinder 82 in the opposite direction. In this fashion a Magnus propeller can be changed in its direction of directing the propeller stream by shifting the cylinder drive shaft 86 axially rather than reversing the direction of rotation of the propeller shaft. The use of a cylinder drive shaft rotating in a direction opposite from the propeller shaft, reduces the size of the bevel gears or bevel members in the hub necessary to drive the Magnus cylinders in rotation.

Figure 11B:
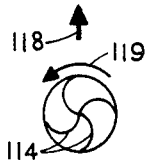
FIG. 11 is an elevation view partly in section of a Magnus propeller that has auto rotating cylinders.
Figure 11A:
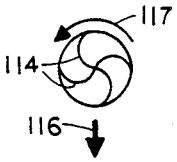
Figure 11:
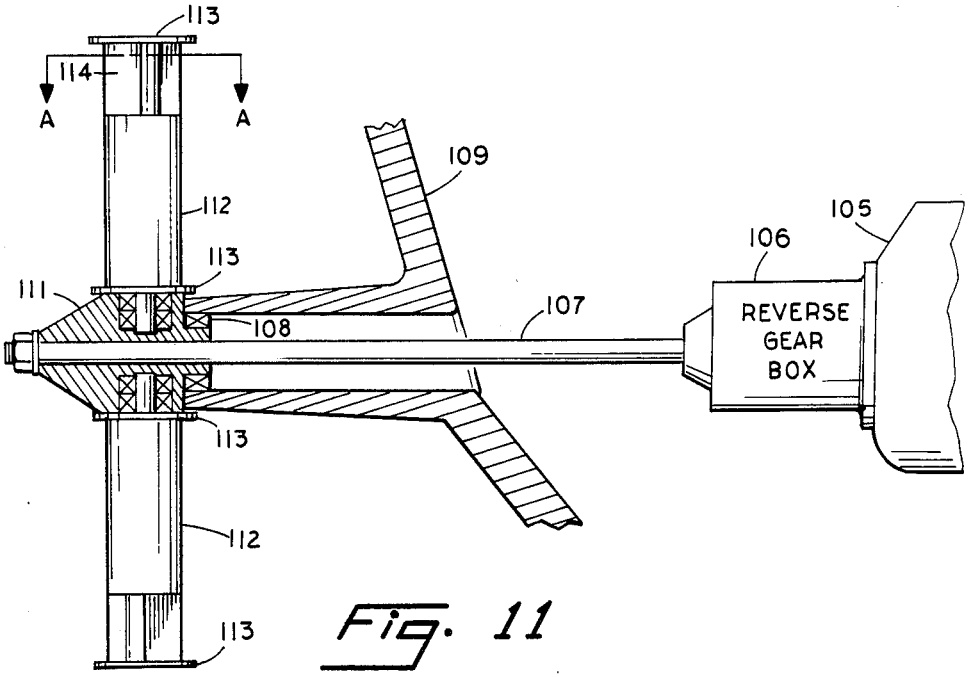

Referring to FIG. 11 there is illustrated a Magnus type of propeller that can be substituted on the shaft of a conventional propeller; in this case the Magnus cylinders of the propeller are provided with vanes that cause the cylinder to rotate as they are revolved around the propeller axis.

Referring to FIG. 11 there is illustrated a conventional engine 105 having a conventional reverse gear box 106 which drives a conventional propeller shaft 107. This shaft 107 is mounted in a conventional propeller bearing 108 situated conventionally in the hub 109 of a boat or ship. Secured to the left end of the shaft 107 is a propeller hub 111 and mounted within this hull for rotation are a plurality of Magnus cylinders 112 having the usual Magnus flanges 113 at each end. Provided particularly in accordance with the improvement are a series of vanes at the outer end of each Magnus cylinder 112. These vanes are designated as 114 and are shown in more detail in FIGS. 11-A and 11-B. Referring to FIG. 11-A when the Magnus cylinders are moved through the water in the direction of the arrow 116 the cylinders will rotate in the direction of the arrow 117. Referring to FIG. 11-B when the Magnus cylinders move through the water in the direction of the arrow 118 the vanes 114 will cause the cylinder to rotate in the direction of the arrow 119 and it will be noted that the rotation is in the same direction for both FIGS. 11-A and 11-B.

The operation of the structure FIG. 11 is as follows. When the propeller shaft 107 rotates the hub 111 in one direction shown by the arrow 116 of FIG. 11-A then a thrust will be developed at right angles to this direction of motion 116. If however, the reverse gear box 106 is operated to reverse the direction of rotation of the propeller shaft 107 then the motion of the cylinders 112 is shown by the arrow 118 in FIG. 11-B and this causes a thrust to be developed 180° from the thrust developed in FIG. 11-A.

Figure 12:
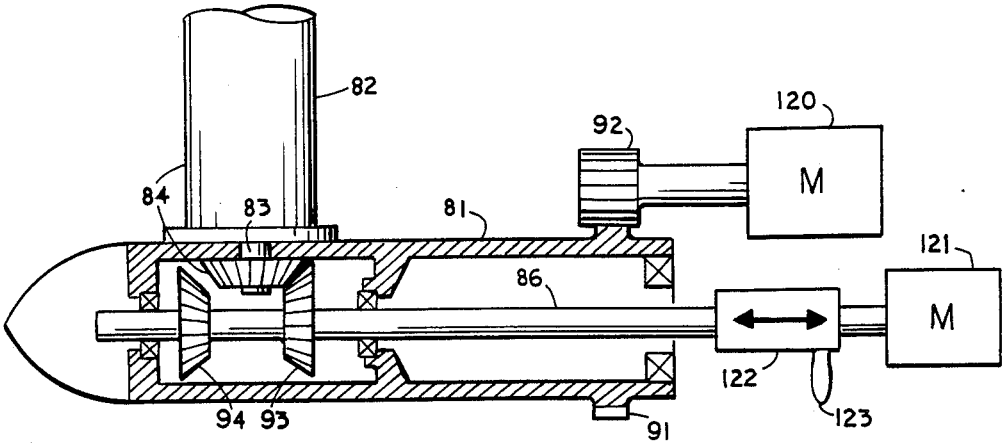
FIG. 12 is an elevation view, partly in section, of a modified form of Magnus propeller wherein the cylinders and propeller shaft have independent mechanical motor drives.

Illustrated in FIG. 12 is the mechanical drive propeller of FIG. 10 wherein the propeller shaft 81 is driven by a motor 120 which is independent of a motor 121 which drives the cylinder drive shaft 86. Interposed between the motor 121 and the cylinder drive shaft 86 is a shifter 122 which may be operated in any suitable fashion, for example by the manual handle 123. Because of the independent power drive for the hollow propeller shaft 81 and the cylinder drive shaft 86, any combination of relative speeds of rotation may be obtained between these two rotatable members. Reversal of thrust from the propeller is obtained as in the FIG. 10 structure by merely shifting the cylinder drive shaft 86 horizontally.

Figure 13:
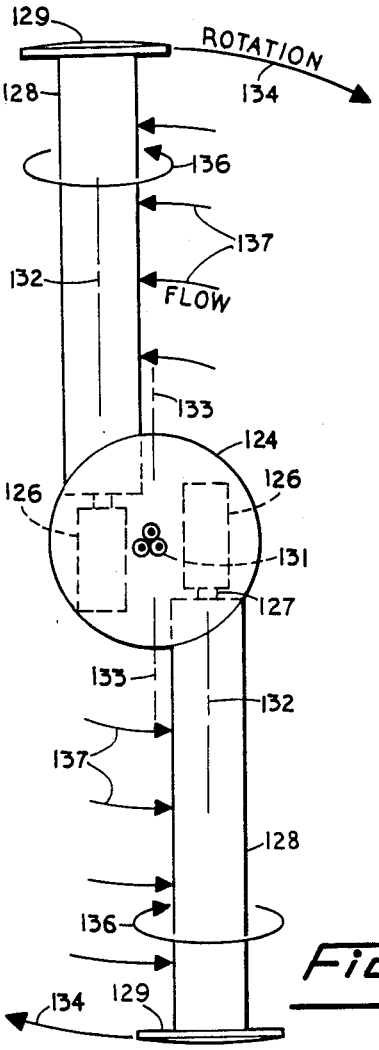
FIG. 13 is a diagram of a modified form of Magnus propeller as viewed from the rear of a vessel as the vessel is moving forward away from the viewer, and in which the cylinders have (fluid or electric) motors located inside the propeller hub, and which are independent of the propeller shaft motor.

Illustrated in FIG. 13 is a modified form of the invention wherein Magnus cylinders are driven by motors located in the hub portion of a hollow propeller shaft. FIG. 13 is a view from the stern of a vessel showing the dynamics of the propeller as it is propelling a vessel forward away from the viewer. A hollow hub 124 houses a pair of motors 126 which are of the rotatable output type and each motor is connected by a shaft 127 to a Magnus cylinder 128 each terminating in a dished cap 129. The motors 126 are supplied with a power by means of conduits or conductors 131 disposed within the hollow hub and its associated propeller shaft. Each cylinder 128 rotates on an axis 132 that is parallel to a radius 133 from the hub 124. The axes 132 could coincide, of course, with a radius by making the hub bigger or the motors 126 smaller to fit that particular type of geometry.

The dynamics of the thrust of the propeller of FIG. 13 are illustrated by the arrows. The hub 124 rotates in the direction of the arrows 134 and each cylinder rotates in the direction of the arrows 136. The rotation 134 causes a relative movement between the cylinders 128 and the fluid in which they are operating, for example air or water, and this relative movement is indicated by the flow arrows 137. This combination of rotation of hub and cylinders results in a thrust toward the viewer which will propel the vessel forwardly away from the viewer of FIG. 13.

Figure 14:
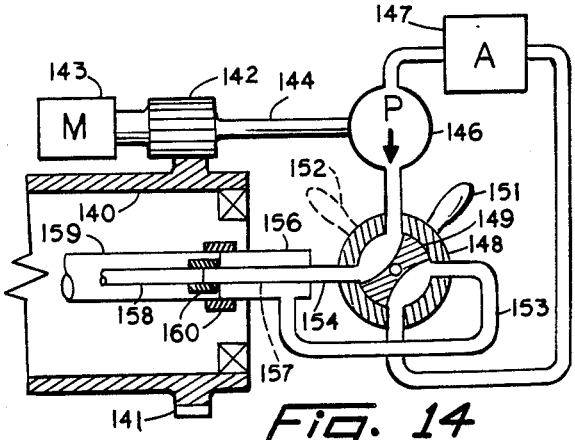
FIG. 14 is a schematic diagram of an electrical drive for the cylinder motors of FIG. 13.

Illustrated in FIG. 14 is a hydraulic drive when the motors 126 of FIG. 13 are hydraulic motors. A hollow propeller shaft 140 has an external gear 141 engaged by a drive spur gear 142 driven by a motor 143. The motor 143 also drives through a shaft 144 a hydraulic pump 146 which takes liquid from an accumulator 147 and delivers it to a reversible valve having a body 148 and a control rotor 149 controlled by a valve handle 151 rotatable from the position shown to a position 152 shown in broken outline. The valve housing 148 has two outlets connected to pipes 153 and 154 which deliver fluid under pressure or exhaust fluid depending upon the position of the handle 151. The two outputs are delivered to a stationary outer pipe 156 and the other output 154 is connected to a stationary pipe 157 disposed within the outer pipe 156. The inner pipe 157 delivers its output to a rotating pipe 158 connected to the hydraulic motors 126 of FIG. 13 and the outer pipe 156 delivers its output to a rotatable pipe 159. The joints between these rotatable and stationary pipes are sealed by rotating couplings 160.

The operation of the device of FIG. 14 is as follows. The motor 143 is energized to rotate the spur gear 142 to rotate the hollow propeller shaft 140, the left end of which houses motors 126 as shown in FIG. 13. The motor 143 drives the pump 146 which takes liquid from an accumulator 147 and delivers it to a reversing and throttling valve 148-149. In the position shown in FIG. 14 the fluid under pressure goes through conduit 154 to the rotating pipe 158 sealed by rotational coupling 160. Exhaust fluid is received from the outer rotating pipe 159 through the stationary pipe 156 to the valve conduit 153 to return to the accumulator 147. In this fashion fluid under pressure can rotate a hydraulic motor, for example, a vane type motor, in either direction to control the direction of rotation of the cylinders 128 of FIG. 13. Not only does the valve 148-149 control the direction of flow, but by careful manual adjustment can control the amount of flow and thereby the speed of rotation of the rotors 128. It will be appreciated that if the pump 146 pumps air rather than liquid, that the accumulator 147 and its return pipe will not be needed.

Figure 15:
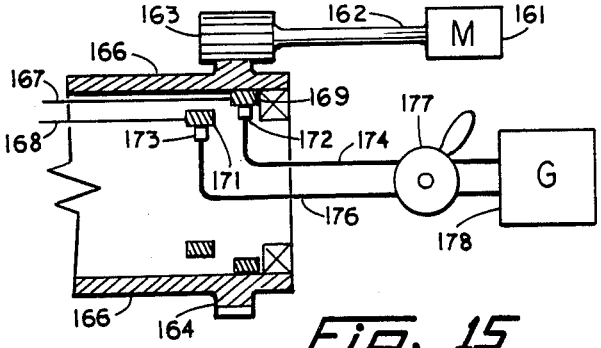
FIG. 15 is a schematic diagram of a fluid drive system for the cylinder motors of FIG. 13.

Referring to FIG. 15, there is illustrated a circuit for supplying electricity to motors 126 of FIG. 13 when these are electric motors. The motor 161 drives a shaft 162 connected to a spur gear 163 which engages an outer gear 164 on a hollow propeller shaft 166. Electric conductors 167 and 168 are connected to slip rings 169 and 171 respectively, which are secured to the rotating propeller shaft 166. These slip rings are engaged by brushes 172 and 173 respectively, which in turn are connected to conductors 174 and 176 leading to a manual controller 177 which controls not only the direction of the current flow, but also the amount of flow so as to control the speed of rotation of the rotors 128 of FIG. 13. The controller 177 receives its electric supply from a generator 178 driven in any suitable manner. The controller 177 may be of any desired construction, for example, the combination of the switch 63 and rheostat 61 of FIG. 5 for schematic purposes.

It will be appreciated that the control of the electric motors and for that matter the hydraulic motors of FIG. 14, may be at the motors themselves rather than externally to the rotating propeller shaft. In this case hydraulic or electrical relays would be used rather than external manual control. The motors 120, 143 and 161 may also be reversible in which case the cylinder motors 126 need not be reversed nor the shaft 86 shifted. Motor 121 may be reversible in which case shifting is not required.

INDUSTRIAL APPLICATION

The Reversible Magnus effect propellers of this application are useful in any type of boat, ship or other vessel as a propulsion mechanism. They are fully as useful as the common screw propeller, but are more efficient in reverse because the usual screw propellers are cupped for forward propulsion and therefore, are less efficient in reverse.

While I have described the invention with respect to presently preferred embodiments thereof these embodiments are illustrative only, and not limiting. There is included within the scope of the following claims all variations and modifications that fall within the true spirit and scope of the invention.

I claim:

1. A Magnus effect propeller for water vessels, comprising:

(a) a propeller hub rotatable about an axis;

(b) at least one Magnus cylinder rotatably mounted on the hub and rotatable about an axis that is radial to the hub axis, said cylinder having an outer end that defines a circle of revolution as the hub is rotated;

(c) a stationary propeller nozzle concentric with the hub axis at the circle of revolution of the cylinder end and having an internal annular groove having a forward edge and a rear edge;

(d) a round axial projection on the outer end of the cylinder that is of less diameter than said width of the groove and projecting into the groove;

(e) and means for shifting the hub along its axis so that the round cylinder projection contacts either the forward or the rear groove edge to rotate the cylinder in one direction or the other as it revolves about its hub axis.

2. Magnus effect propeller as set forth in claim 1 wherein element c is a ring disposed at the circle of revolution and the ring has said internal annular groove having a forward edge and a rear edge.

3. A Magnus effect propeller for water vessels, comprising:

(a) a propeller hub rotatable about an axis;

(b) at least one Magnus cylinder rotatably mounted on the hub and rotatable about an axis that is radial to the hub axis;

(c) a cylinder drive shaft concentric with the hub axis;

(d) a pair of spaced drive means connected to the cylinder drive shaft for alternatingly driving the cylinder in one direction or the other on its axis that is radial to the hub axis;

(e) means for shifting the cylinder drive shaft along its axis so that the cylinder is driven by only one of said spaced drive means;

(f) and power means for rotating the hub and the cylinder drive shaft.

4. A Magnus effect propeller for water vessels, comprising:

(a) a propeller hub rotatable about an axis;

(b) at least one Magnus cylinder rotatably mounted on the hub and rotatable about an axis that is radial to the hub axis, said cylinder having an outer end that defines a circle of revolution as the hub is rotated;

(c) a stationary propeller nozzle concentric with the hub axis at the circle of revolution of the cylinder end and having an internal annular groove having a forward edge and a rear edge;

(d) a round axial projection on the outer end of the cylinder that is of less diameter than said width of the groove and projecting into the groove; and (e) means for shifting the hub and the nozzle relative to each other along the hub axis so that the round cylinder projection contacts either the forward or the rear groove edge to rotate the cylinder in one direction or the other as it revolves about its hub axis.

5. The method of reversing the thrust of a Magnus propeller having a hub rotatable in either direction about an axis and a Magnus cylinder connected to the hub and continuously rotatable in either direction about an axis that is generally radial to the hub axis comprising:

(a) driving continuously through multiple 360° rotations the hub and the cylinder with independent reversible power means;

(b) and reversing one of said power means.

6. A reversible Magnus effect propeller comprising:

(a) a propeller hub rotatable about a hub axis;

(b) at least one Magnus cylinder rotatably mounted on the hub and rotatable in either direction about an axis generally radial to said hub axis;

(c) means for rotating the hub;

(d) reversible power means connected to the Magnus cylinder and independent of the means for rotating the hub for rotating the cylinder in either direction;

(e) and manual control means for said reversible power means, whereby the propeller reverses thrust by reversing the direction of rotation of the cylinders.

7. A reversible Magnus effect propeller as set forth in claim 6 wherein element d) includes a rotatable shaft disposed within the hub and a mechanical drive between the cylinder and shaft, and the reversible power means is connected to the shaft.

8. A reversible Magnus effect propeller comprising:

(a) a propeller hub rotatable about a generally horizontal hub axis;

(b) at least one Magnus cylinder rotatably mounted on the hub and rotatable in either direction about an axis generally parallel to a radius to said hub axis;

(c) means for rotating the hub;

(d) a reversible, rotatable output motor disposed in the hub and coupled to the cylinder for rotating the cylinder in either direction;

(e) a power source connected to said motor to effect rotation in either direction;

(f) and means for reversing the direction of rotation of the motor.

9. A reversible Magnus effect propeller as set forth in claim 8 wherein the reversible motor is a fluid motor and the reversible power source supplies fluid under pressure to the motor.

10. A reversible Magnus effect propeller as set forth in claim 8 wherein the reversible motor is an electric motor and the reversible power source supplies electric current to the motor.

11. A reversible Magnus effect propeller comprising:

(a) a propeller hub rotatable in either direction about a hub axis;

(b) at least one Magnus cylinder rotatably mounted on the hub and rotatable in either direction about an axis generally parallel to a radius to said hub axis;

(c) a first reversible power means connected to the hub for rotating the hub in either direction;

(d) a second reversible power means connected to the cylinder for rotating the cylinder in either direction;

(e) and means for reversing the direction of rotation of one of said reversible power means; whereby reversing the direction of rotation of said hub or cylinder will reverse the Magnus thrust.

* * * * *